US006729314B2

(12) United States Patent
Radhamohan et al.

(10) Patent No.: US 6,729,314 B2
(45) Date of Patent: May 4, 2004

(54) STAGED TRANSLATION CONTROL ALGORITHM FOR REDUCTION IN IMPACT FORCE

(75) Inventors: Subbaraya Radhamohan, Novi, MI (US); Simon T. Joque, Northville, MI (US)

(73) Assignee: Eaton Corporation, Cleveland, OH (US)

( * ) Notice: Subject to any disclaimer, the term of this patent is extended or adjusted under 35 U.S.C. 154(b) by 37 days.

(21) Appl. No.: 10/073,713

(22) Filed: Feb. 11, 2002

(65) Prior Publication Data

US 2003/0150435 A1 Aug. 14, 2003

(51) Int. Cl.[7] ..... F02B 47/108
(52) U.S. Cl. ..... 123/568.21; 123/568.23
(58) Field of Search ..... 123/568.21, 568.23, 123/568.24, 568.26; 251/129.11, 129.12, 129.13, 129.04; 318/611, 612, 615

(56) References Cited

U.S. PATENT DOCUMENTS 5,937,835 A * 8/1999 Turner et al. ..... 123/568.24
6,012,437 A 1/2000 Radhamohan et al. . 123/568.23
6,102,016 A * 8/2000 Sitar et al. ..... 123/568.23
6,415,776 B1 * 7/2002 Gates et al. ..... 123/568.24
6,575,149 B2 * 6/2003 Gagnon ..... 123/568.24

* cited by examiner

*Primary Examiner*—Mahmoud Gimie
(74) *Attorney, Agent, or Firm*—L. J. Kasper

(57) ABSTRACT

A method of operating a control system to move an EGR valve (24) toward its seat (32), in which the control system includes an actuator (16) operable in response to an electrical position command signal (84, 86). The method comprises the steps of determining (102) if the valve is being commanded toward a closed position, and determining (106) if the valve is still at least a predetermined distance (X) from a Stage 1 Position. If both answers are affirmative, the valve is commanded toward the Stage 1 Position, then the logic determines when the valve is within a predetermined tolerance (T) of the Stage 1 Position, and when it is, the logic provides a position command signal corresponding to an unchanging position of the valve for a predetermined period of time (Y), while any overshoot of the valve position settles out, and the valve position stabilizes before the logic proceeds with the rest of the closing operations. The result is greatly reduced stress on the valve (24) and the gear train which drives the valve.

5 Claims, 6 Drawing Sheets

STAGED TRANSLATION CONTROL ALGORITHM FOR REDUCTION IN IMPACT FORCE

BACKGROUND OF THE DISCLOSURE

The present invention relates to control systems for moving objects rapidly toward engagement with some sort of stop, and more particularly, to an improved method for operating such a control system.

Although the method of the present invention may be used for operating control systems to move various types of objects toward engagement with various types of stops, the present invention is especially suited for use in operating a control system for an exhaust gas recirculation (EGR) valve as it moves toward its valve seat, and will be described in connection therewith.

EGR systems are employed in automotive vehicles in order to help reduce engine emissions. Such EGR systems typically utilize an EGR poppet valve that is disposed between the engine exhaust manifold and the engine intake manifold and is operable, when in an open position, to permit recirculation of exhaust gas from the exhaust manifold back into the intake manifold.

An actuator is employed for moving the EGR valve between its open and closed positions, because the recirculation of exhaust gasses is appropriate and helpful only at certain times, as is well know to those skilled in the EGR art, and therefore will not be discussed in greater detail hereinafter. EGR valves of the type with which the present invention may be utilized are illustrated and described in U.S. Pat. Nos. 5,937,835 and 6,102,016, both of which are assigned to the assignee of the present invention and incorporated herein by reference.

Electrically actuated EGR valve systems preferably employ software-implemented control logic such that the EGR valve is operating under closed loop control when the EGR valve is being moved from a closed position to an open position and when the EGR valve is being moved from an open position to a closed position. As used herein, the term "closed loop" in regard to the control of the EGR valve will be understood to mean that the control logic is constantly "reading" the position of the EGR valve and utilizing the position of the EGR valve as part of the feedback to the control logic. The closed loop control logic controls electrical current to an electric motor which serves as the actuator to control the position of the EGR valve. In such systems, the control logic may generate pulse width modulated (PWM) signals to power the actuator motor and modulate the acceleration and deceleration of the EGR valve, as it moves from one position to another.

For purposes of the present invention, the portion of the total operating cycle of an EGR valve which is of greatest concern is whenever the EGR valve is being moved from an open position to a closed position, in which the EGR valve engages its "stop". Typically, an EGR valve is a poppet valve of the same general configuration and construction as an engine intake or exhaust poppet valve, in which case the "stop" is a valve seat of the conventional type. Moving the EGR valve to a closed position is of concern for several reasons, and as is typical, involves a tradeoff. On the one hand, when the control logic commands the actuator to close the EGR valve, it is desirable to close the EGR valve quickly, thus stopping the flow of EGR gasses from the exhaust manifold back into the intake manifold. On the other hand, if the EGR valve is closed too quickly (too high a current to the actuator motor), one likely result would be a dynamic engagement of the EGR valve with its valve seat, thus inducing stresses in the EGR valve itself, and also in the linkage between the electric motor and the EGR valve.

Among the known closing logic arrangements is that illustrated and described in U.S. Pat. No. 6,012,437, assigned to the assignee of the present invention and incorporated herein by reference. The incorporated patent teaches the concept of controlling an EGR valve, during the closing mode, by first controlling the EGR valve under closed loop control until the valve reaches a predetermined distance from the valve seat, and then subsequently, operating the EGR valve under open loop control until the valve engages the valve seat. As used herein, "open loop" control will be understood to refer to a control mode in which the logic does not utilize valve position as a feedback to the logic. The purpose of the logic of the above-incorporated patent is to close the valve and hold it closed (sealed relative to its seat) with a known current which remains fairly constant, and within a "safe" range for the particular application.

It has been observed by the assignee of the present invention, in the course of developing EGR valves and control systems for commercial use, that impact engagement of the EGR valve with its valve seat may occur much more frequently than is desirable. In addition, such impact engagements may involve excessive impact force and stress on the gear train driving the EGR valve.

BRIEF SUMMARY OF THE INVENTION

Accordingly, it is an object of the present invention to provide an improved method for operating a control system to move an object rapidly toward engagement with a stop, in which the improved method overcomes the disadvantages of the generally known prior art.

It is a more specific object of the present invention to provide a method of operating an electrical control system to move an EGR valve rapidly toward engagement with its valve seat, but with almost no likelihood of a premature impact engagement of the EGR valve and its valve seat.

The above and other objects of the invention are accomplished by the provision of an improved method of operating a control system to move an object rapidly toward engagement with a stop, the control system including an actuator operable in response to an electrical position command signal to move the object toward the engagement with the stop.

The improved method of operating the control system comprises the steps of determining if the object is being commanded toward a position within a predetermined distance of the stop. The next step is determining if the object is still at least a predetermined distance from a first position. If the answer to the first step is affirmative and the answer to the second step is affirmative, the next step is commanding the object to the first position, and then determining if the object is within a predetermined tolerance of the first position, and when it is, providing a position command signal corresponding to a substantially unchanging position of the object for a predetermined time period. After the predetermined time period, the next step is continuing the move of the object from the first position toward the engagement with the stop.

DETAILED DESCRIPTION OF THE PREFERRED EMBODIMENT

Figure 1:
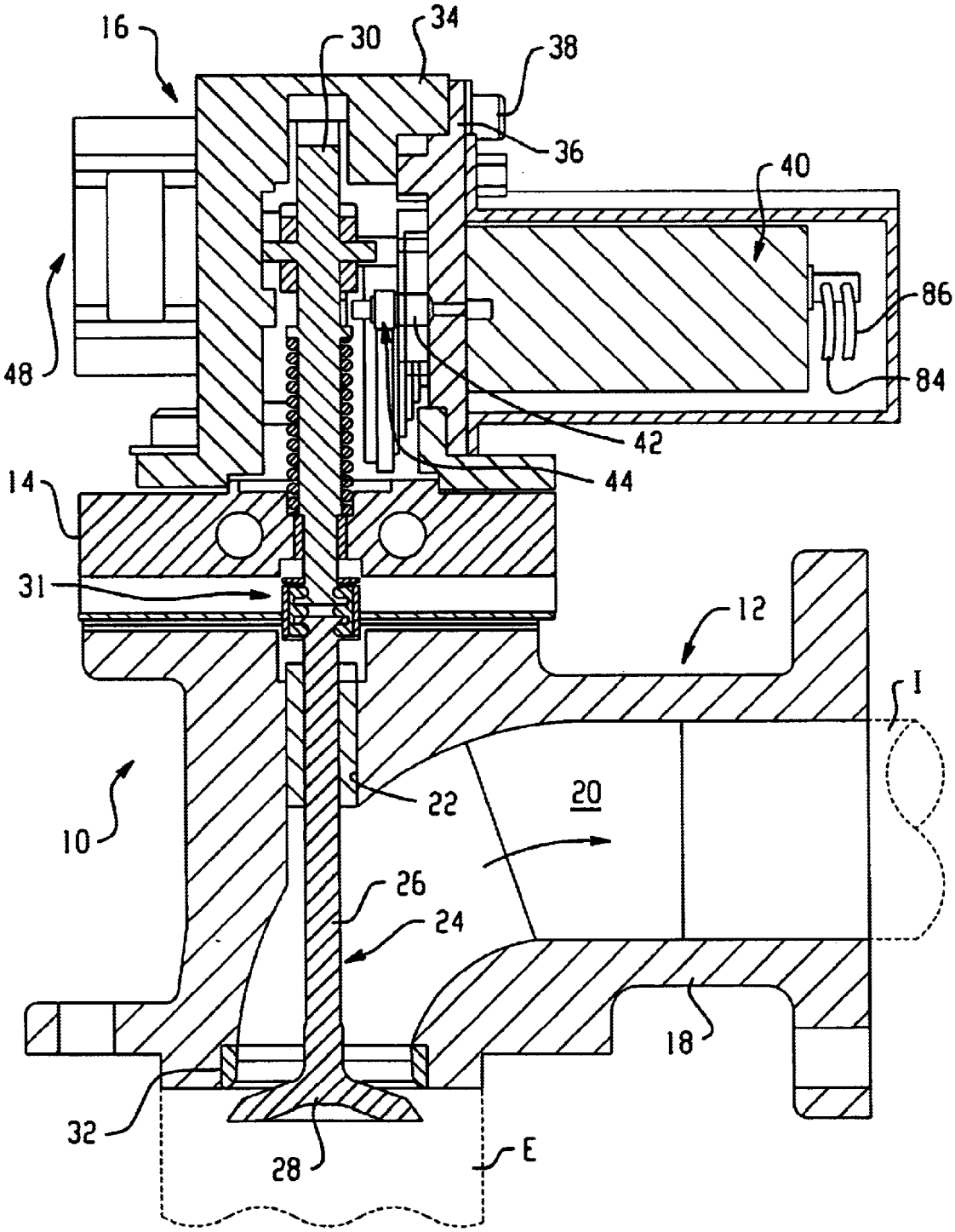
FIG. 1 is a transverse cross-section of an exhaust gas recirculation valve and control system therefor.

Referring now to the drawings, which are not intended to limit the invention, FIG. 1 illustrates an electrically-actuated EGR valve control system, generally designated 10. The control system 10 is an EGR valve control system of the type illustrated and described in greater detail in the above-incorporated U.S. Pat. No. 5,937,835. As is well know to those skilled in the art, the EGR system 10 includes a manifold portion 12, a heat transfer (cooling) portion 14, and an actuator portion 16.

The manifold portion 12 includes a manifold housing 18 that defines a flow passage 20. At the upstream end of the flow passage 20, the manifold portion 12 is connected to an exhaust passage E, and, at the downstream end of the flow passage 20, the manifold portion 12 is connected to an intake passage 1. The manifold housing 18 also defines a bore 22 within which a valve assembly, generally designated 24, is reciprocally supported for axial movement therein. Valve assembly 24 includes a valve stem 26 that is integrally formed with a poppet valve 28, and an input stem portion 30 that is coupled to the valve stem 26 by means of a coupling arrangement 31, such that the input stem portion 30 and the valve stem 26 have common axial movement. It should be understood, however, that such a coupling arrangement is not an essential feature of the invention. The manifold housing 18 further includes a valve seat 32 against which the poppet valve 28 seats or engages when the valve assembly 24 is closed, such that the valve seat 32 serves as a "stop" for the closed position of the valve assembly 24. It should be noted that in FIG. 1, the valve assembly 24 is shown in its open position.

Actuator portion 16 includes an actuator housing 34 to which is attached a housing cover 36 by means of bolts 38 or any other suitable means. Attached to the exterior of the housing cover 36 is the casing of an electric motor, generally designated 40. Although the particular construction and specification of the electric motor 40 are not essential features of the present invention, the motor 40 preferably is of the relatively high speed, continuously rotating type, and is preferably one with a high torque-to-inertia ratio, such as a permanent magnet DC commutator motor. As is described in greater detail below, control logic controls the functioning of the electric motor 40 by means of electrical connections 84 and 86.

The electric motor 40 of the actuator portion 16 provides a low torque, high speed rotary output at a motor output shaft 42 which drives a gear train, generally designated 44. The gear train 44 translates the relatively low torque, high speed rotary output of the motor 40 into a relatively high torque, low speed rotary output. The output, as described above, of the gear train 44 is then converted by means of a linkage, not shown herein, into axial movement of the input stem portion 30, and of the entire valve assembly 24. In view of the fact that the present invention is not limited specifically to an EGR valve control system, it should be even more apparent that the invention is not limited to any particular configuration of EGR valve, gear train, actuator, etc.

Attached to the actuator housing 34 is a sensor assembly, generally designated 48, the function of which is to sense the axial position of the valve assembly 24. The sensor assembly 48 converts the sensed position into an appropriate electrical signal that is transmitted as an input to control logic (to be described hereinafter) that controls the functioning of the electric motor 40. In the preferred embodiment, the sensor assembly 48 is a resistive position sensor of the type typically used in the vehicle industry for throttle position measurements.

Figure 2:
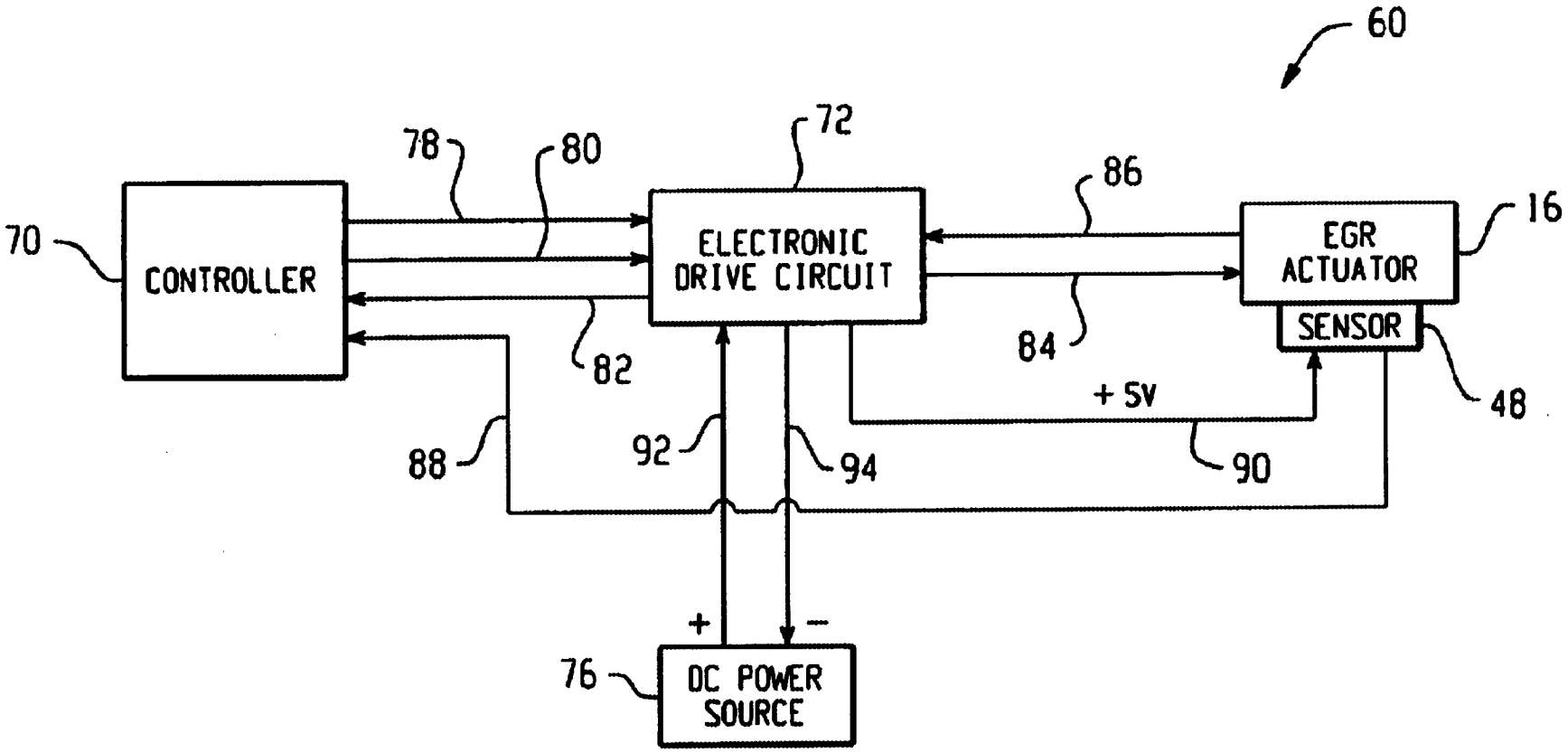
FIG. 2 is an electrical block diagram of an EGR valve control system of the type with which the present invention may be utilized.

Referring now primarily to FIG. 2, there is illustrated an electrical block diagram of a control 60 for controlling the EGR valve control system 10. Included in the control 60 is a controller 70, a drive circuit 72, the EGR actuator portion 16 (including the electric motor 40), and the sensor assembly 48. In the preferred embodiment, the controller 70 is a microprocessor-based controller which has been appropriately modified and protected to be able to withstand the under-the-hood environment, in terms of vibration, heat, etc. The control logic included within the controller 70 controls the functioning of the electric motor 40, and is described in greater detail below. The controller 70 and the drive circuit 72 are electrically coupled by means of electrical connections 78, 80 and 82. The controller 70 provides a motor-actuating signal and a direction signal to the drive circuit 72 by means of the electrical connections 78 and 80, respectively. In the preferred embodiment, the motor-actuating signal 78 is a PWM (pulse-width modulated) signal, of the general type which is known to those skilled in the art, although other types of signals, such as analog signals, may also be utilized.

The direction signal 80 indicates whether the valve assembly 24 is to be moved toward a closed position (with the poppet valve 28 engaging the valve seat 32) or is to be moved toward the open position shown in FIG. 1, with either a clockwise or counter-clockwise rotation of the motor 40 providing the appropriate axial movement to the valve assembly 24. The drive circuit 72 provides a current feedback signal to the controller 70 by means of the electrical connection 82 and by means of this feedback signal 82, the controller 70 can detect if over-current conditions are present in the motor 40, so that electrical power to the motor 40 can be discontinued. The controller 70 receives a position signal from the sensor assembly 48 by means of an electrical connection 88, with the position signal being indicative of the axial position of the valve assembly 24, as was mentioned previously. In the preferred embodiment, the controller 70 and the drive circuit 72 are located within the engine compartment of the vehicle, preferably in close proximity to the EGR valve control system 10.

The drive circuit 72 receives input from the controller 70 by means of the electrical connections 78 and 80, as described previously, and in response thereto, drives the electric motor 40 of the EGR actuator portion 16. Operating as a "power amplifier" with respect to the PWM signal 78, the drive circuit 72 supplies a bi-directional current to the electric motor 40 by means of the electrical connections 84 and 86. The drive circuit 72 receives power from a power source 76 by means of electrical connections 92 and 94 and supplies a +5 Volt regulated DC operating voltage to the position sensor 48 by means of an electrical connection 90. A variety of generally satisfactory drive circuits are well know to those skilled in the art and therefore, the drive circuit 72 will not be described in detail hereinafter, a preferred embodiment thereof being illustrated and described in the above-incorporated U.S. Pat. No. 6,012,437.

Figure 3:
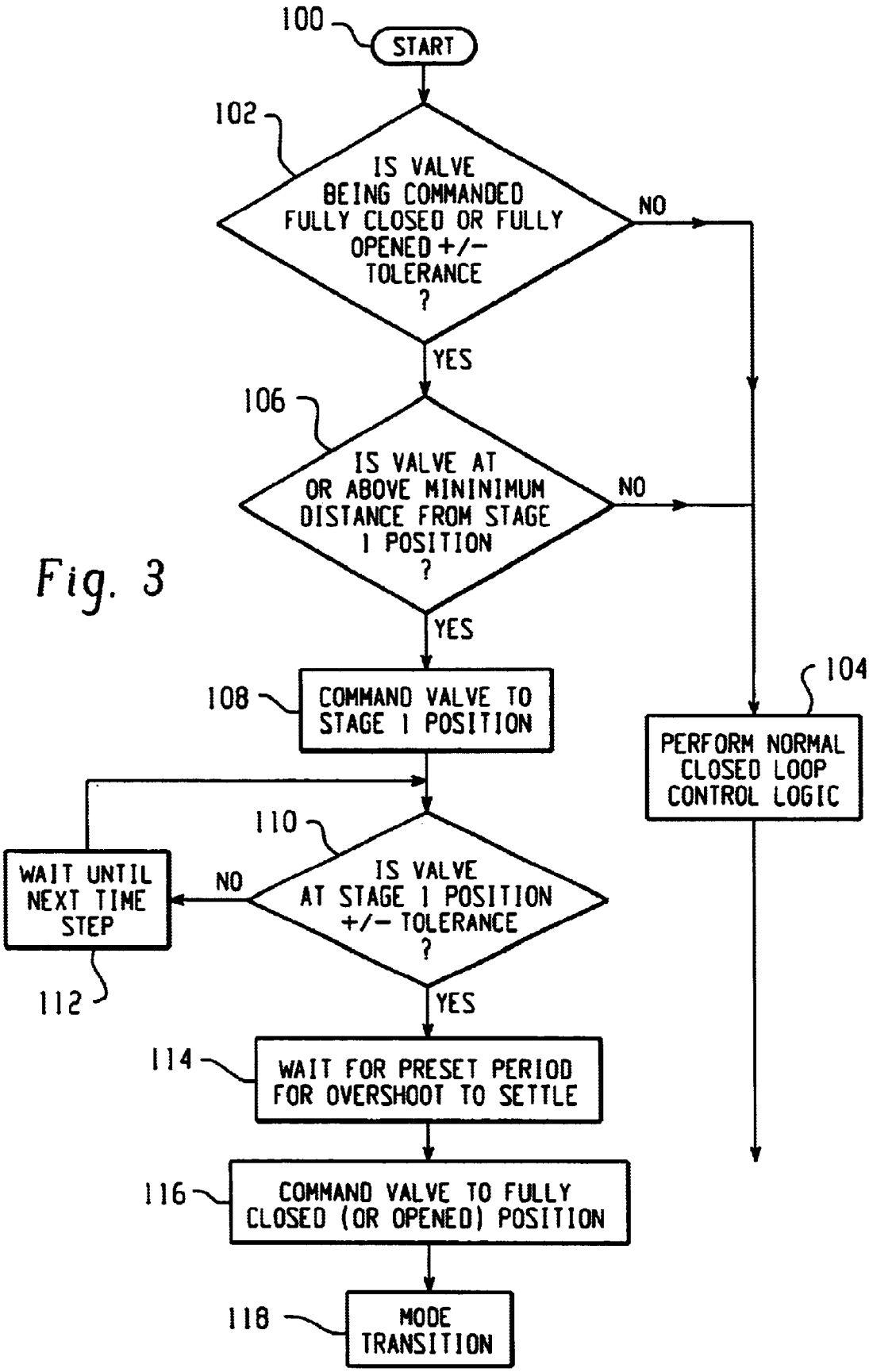
FIG. 3 is a logic flow chart for the control logic of the present invention.
Figure 3A:
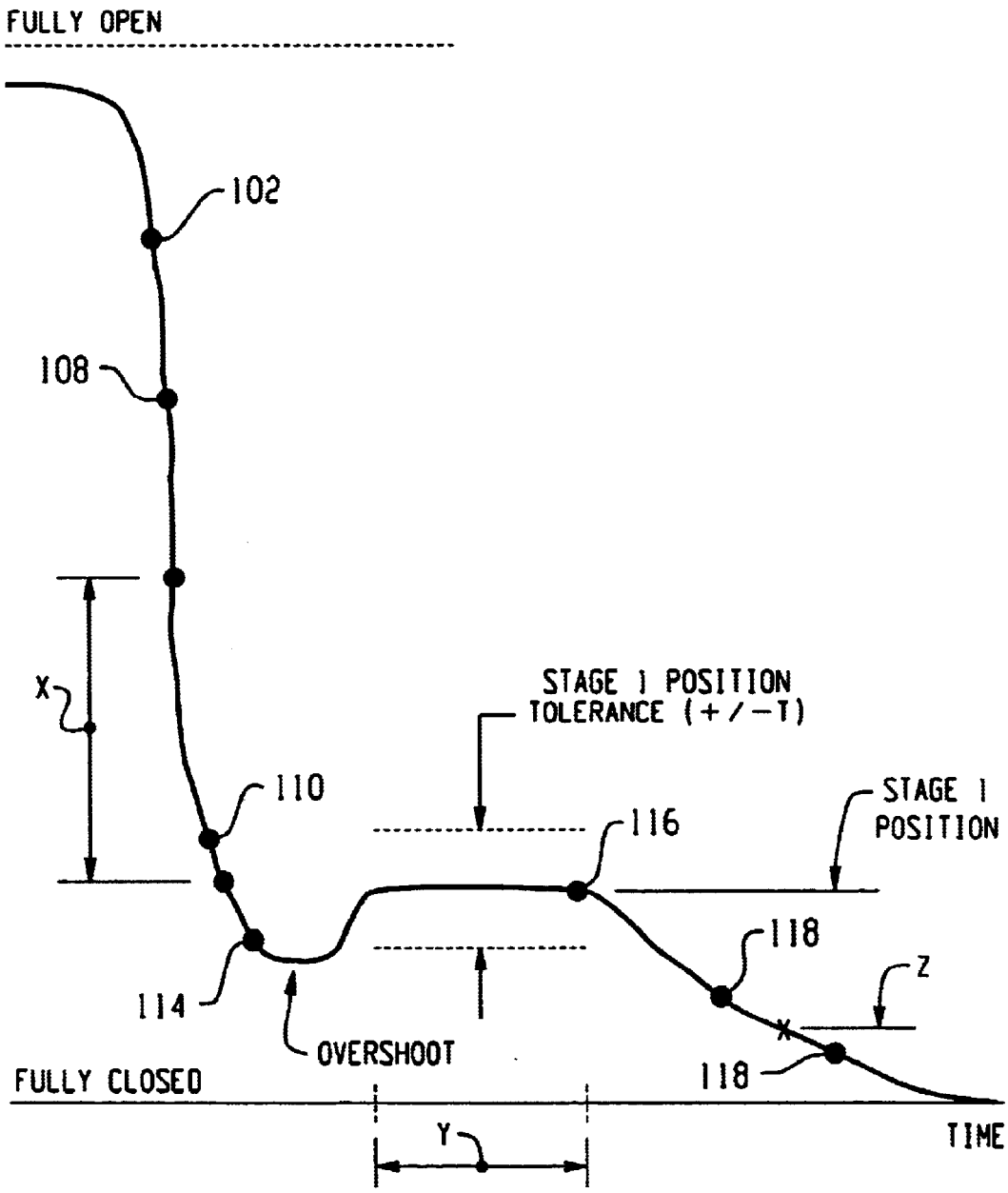
FIG. 3A is an enlarged graph of EGR valve position, as a function of time, illustrating one important aspect of the present invention.

Referring now primarily to FIGS. 3 and 3A, there is illustrated a logic flow chart illustrating several important aspects of the present invention. The control logic illustrated in the flow chart of FIG. 3 is implemented in the controller 70, and by means of the electrical connections 84 and 86, controls the electric motor 40 and therefore, the position of the valve assembly 24. The control logic begins at a block 100 and proceeds, after any number of standard start-up operations (not shown), to a decision block 102. In the decision block 102, the logic determines if the valve assembly 24 has been commanded to be either fully closed or fully opened, as opposed to being only partially closed or partially opened. Those skilled in the art of EGR valve systems will understand that, at any given point in time, the decision to open or close the valve, and to do so fully or partially, is determined in connection with a number of engine and vehicle operating parameters, a discussions of which would be beyond the scope of the present invention, and therefore will not be discussed herein in detail.

In describing the control logic shown in FIG. 3, reference will also be made to the graph of EGR valve position, as a function of time, in FIG. 3A, and at various locations on the graph there are certain reference numerals (between 102 and 118) located on the graph to indicate, by way of example only, the position (or in some cases, one possible position) of the valve assembly 24 when the particular logic step from FIG. 3 is to be performed. If the result of the decision block 102 is negative ("No"), the control logic proceeds to an operation block 104, under which the logic performs in a normal closed loop mode, whether the valve assembly 24 is being opened or closed. If the result of the decision block 102 is positive ("Yes"), the logic then proceeds to another decision block 106 which determines whether or not the valve assembly 24 is, at that point in time, positioned at or above a predetermined minimum distance "X" from a so-called "Stage 1 Position".

If the result of the decision block 106 is negative ("No"), indicating that the valve 24 is already separated from the Stage 1 Position by less than the predetermined minimum distance X, the control logic then proceeds to the operation block 104, as was described previously. On the other hand, if the result of the decision block 106 is positive ("Yes"), the control logic then proceeds to an operation block 108, under which the control logic generates the appropriate command signals, and transmits those signals by means of the electrical connections 84 and 86, to command the valve to the Stage 1 Position (see FIG. 3A). It is an important aspect of the present invention that the Stage 1 Position be selected, for the particular object being moved, such that commanding the object to the Stage 1 Position will move the object close to its stop but, taking into account any potential over-travel or overshoot, the object will not engage its stop at this stage of the control process, as a result of such overshoot.

After the operation block 108, the control logic then proceeds to a decision block 110, in which the control logic determines if the valve 24 is at the Stage 1 Position (plus or minus some predetermined tolerance T). If the result of the decision block 110 is negative, the control logic then proceeds to an operation block 112 which merely performs a "waiting" operation i.e., as the logic timer is incremented, the operation block 112 senses that the timer has been incremented and permits the control logic to loop back, as shown in FIG. 3, to a location upstream of the decision block 110. When, eventually, the result of the decision block 110 is positive, the logic then proceeds to an operation block 114.

In the operation block 114, the control logic again performs a "waiting" operation in which the control logic now recognizes the likelihood that the position of the valve 24 has engaged in "overshoot" of its intended position (i.e., the Stage 1 Position) and the logic simply waits for the overshoot to "settle" (i.e., for the position of the valve 24 to become equal to the Stage 1 Position, and remain (stabilize) at that position for some predetermined period of time Y (see FIG. 3A).

The control logic then proceeds to an operation block 116 in which the control logic generates an appropriate command signal to command the valve 24 to its fully closed position, in engagement with its stop (the valve seat 32). It should be understood by those skilled in the art, and it may be seen in FIG. 3A, that the rate at which the valve is closed, under operation block 116, is substantially less than the rate it was closing under the operation block 108, thus the more gradual slope in that portion of the valve position curve in FIG. 5. It should be noted in the graph of FIG. 5, that the overshoot shown in the graph of FIG. 3A is not included, primarily for ease of illustration, recognizing that the graph of FIG. 3A is greatly enlarged relative to that of FIG. 5.

It should also be understood that under the operation block 116, the control logic is still moving the valve 24 in a closed loop mode, as that term was defined hereinabove. After the operation block 116, the control logic then proceeds to an operation block 118, under which the control logic operates to accomplish a Mode Transition in accordance with the teachings of the above-incorporated U.S. Pat. No. 6,012,437. Therefore, under the operation block 118, the control logic continues to move the valve 24 toward its stop in a closed loop mode, until the valve 24 is at a predetermined distance Z from the stop (see FIG. 3A), after which the logic moves the valve the remainder of the distance to the stop, but operates now in an open loop mode, thus the reference numeral "118" appears in FIG. 3A both above and below the line referenced "Z". As was mentioned previously, one primary difference, for a control system of this type, between the closed loop and open loop modes of operation is that the electrical current to the electric motor 40 will, in the open loop mode, be defined to be relatively constant and within a safe range, and preferably, will be approximately equal to that which is required simply as a "holding" current, i.e., a level of electrical current required to hold (maintain) the valve 24 in its closed position. By way of contrast, in the closed loop mode of operation, the current to the electric motor 40 may vary greatly, as the logic attempts to compensate for the sensed position of the valve 24.

Figure 4:
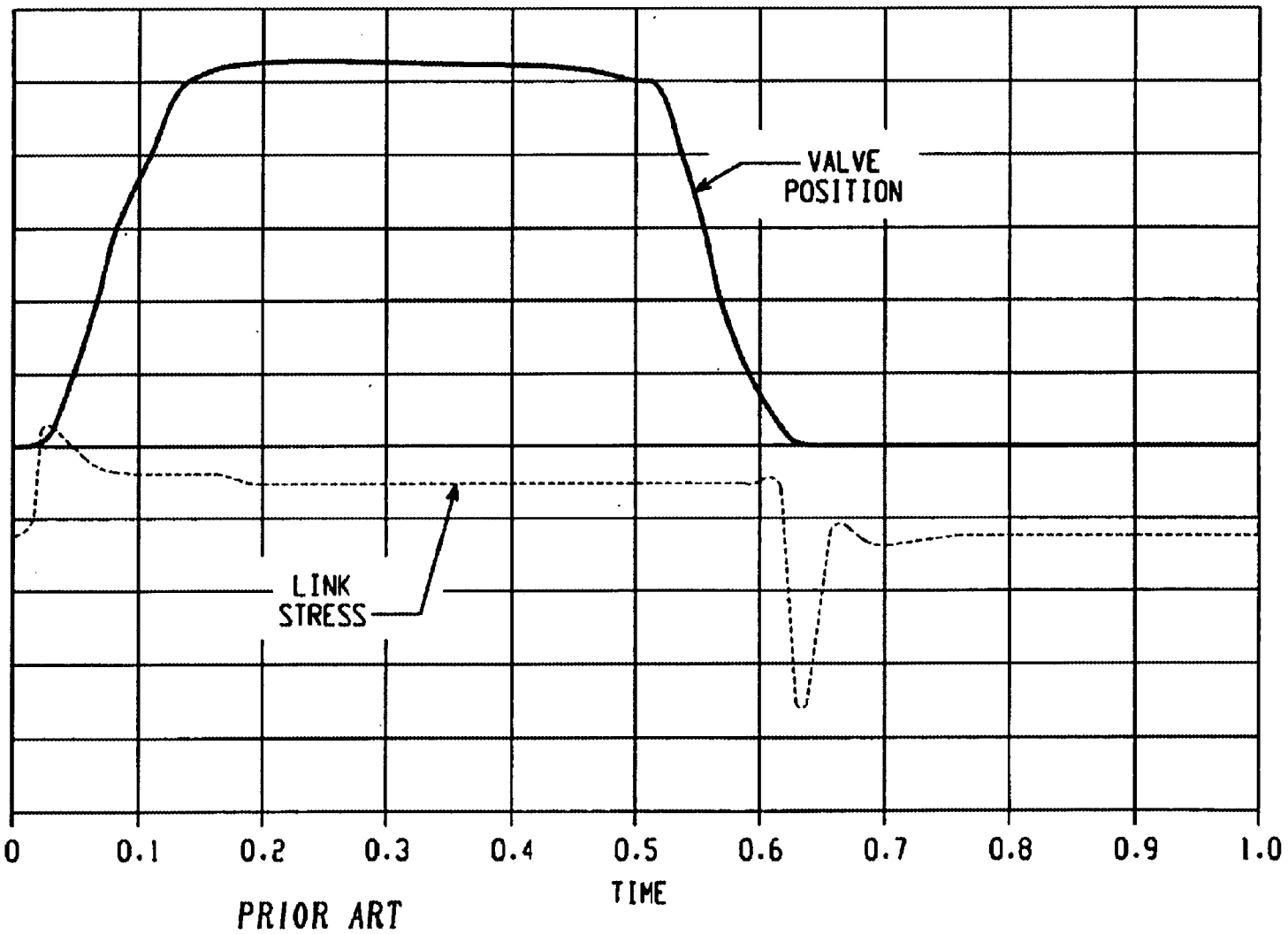
FIGS. 4 and 5 are graphs of EGR valve position and linkage stress, as a function of time, for the prior art and the present invention, respectively.
Figure 5:
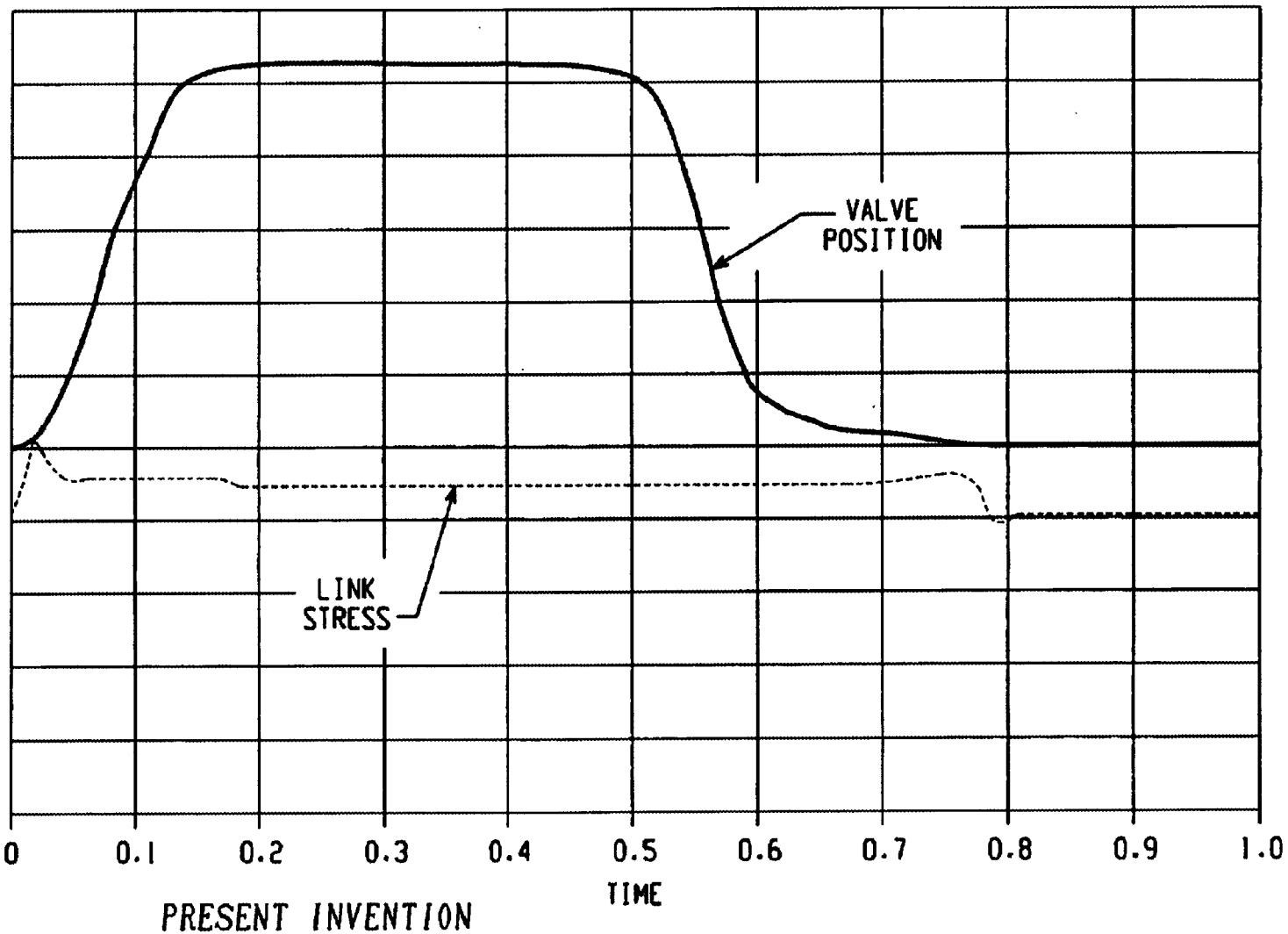

Referring now primarily to FIGS. 4 and 5, the present invention will be compared to the prior art. What is most significant about the graphs of FIGS. 4 and 5 is that, just as the valve position reaches zero (closed) in the prior art, there is a substantial spike in the "Link Stress", i.e., in the stress induced in the linkage between the gear train 44 and the input stem portion 30. Although graphically, the stress is represented as a negative quantity, those skilled in the art will understand that the spike in the stress level, as shown in FIG. 4, is very undesirable. By way of contrast, using the logic of the present invention, just after the valve position reaches zero, there is a small increase in Link Stress, on the order of about one-third of the stress which occurred with the prior art arrangement. The substantial decrease in the Link Stress is the direct result of the fact that, with the present invention, the valve 24 engages its stop with much less energy than in the case of the prior art (without the logic of the invention).

It should be understood by those skilled in the art that, if desirable, the present invention may be utilized in several stages, i.e., instead of achieving a Stage 1 Position, and then going into the Mode Transition logic, the logic could achieve Stage 1 Position, then repeat the same series of logic steps to achieve a Stage 2 Position (not illustrated herein), then a Stage 3 Position, etc., before going to the Mode Transition logic. At each successive stage, the valve 24 would be closer to the stop, and preferably would be moving somewhat slower, thus reducing the anticipated overshoot.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A method of operating a control system to move an object toward engagement with a stop, the control system including an actuator operable in response to an electrical position command signal to move said object toward said engagement with said stop; the method comprising the steps of:

(a) determining if said object is being commanded toward a position within a predetermined distance of said stop;

(b) if the answer to step A is affirmative, determining if said object is still at least a predetermined distance (X) from a first position (Stage 1 Position);

(c) if the answer to step (a) is affirmative and the answer to step (b) is affirmative, commanding said object to said first position (Stage 1 Position);

(d) determining if said object is within a predetermined tolerance (T) of said first position (Stage 1 Position) and when it is, providing a position command signal corresponding to a substantially unchanging position of said object for a predetermined time period (Y); and (e) after said predetermined time period (Y), continuing the move of said object from said first position (Stage 1 Position) toward said engagement with said stop.

2. A method of operating a control system as claimed in claim 1, characterized by said object comprising a poppet valve and said stop comprising a valve seat.

3. A method of operating a control system as claimed in claim 1, characterized by, if either the answer to step (a) is negative or the answer to step (b) is negative, then proceeding to move said object toward said stop under normal closed loop control.

4. A method of operating a control system as claimed in claim 1, characterized by step (d) including said predetermined time period (Y) being selected to permit the position of said object to stabilize at said first position (Stage 1 Position).

5. A method of operating a control system as claimed in claim 1, characterized by step (e) including, first, the step of moving said object under closed loop control until said object reaches a second position (Z), closer to said stop than said first position (Stage 1 Position), then second, the step of moving said object under open loop control from said second position (Z) toward said engagement with said stop.

* * * * *